US005992426A

United States Patent [19]

Yuhara

[11] Patent Number: 5,992,426

[45] Date of Patent: Nov. 30, 1999

[54] COSMETIC CONTAINER

[75] Inventor: Yukitomo Yuhara, Abiko, Japan

[73] Assignee: Yoshida Industry, Ltd., Japan

[21] Appl. No.: 09/283,951

[22] Filed: Apr. 1, 1999

[30] Foreign Application Priority Data

Apr. 2, 1998 [JP] Japan ..... 10-090045
Apr. 14, 1998 [JP] Japan ..... 10-103098

[51] Int. Cl.[6] ..... A45D 33/00

[52] U.S. Cl. ..... 132/293; 132/286; 220/844; 206/581

[58] Field of Search ..... 132/293, 295, 132/315, 286; 206/524.1, 581, 823; 220/844, 835, 469, 324, 335

[56] References Cited

U.S. PATENT DOCUMENTS

| | | | |
|---|---|---|---|
| 2,737,189 | 3/1956 | Morningstar et al. | 132/293 |
| 4,349,120 | 9/1982 | DiNardo | 220/844 |
| 4,693,392 | 9/1987 | Contreras, Sr. | 220/844 |
| 5,320,239 | 6/1994 | Favre | 220/835 |

FOREIGN PATENT DOCUMENTS

| | | |
|---|---|---|
| 50-44316 | 12/1975 | Japan . |
| 52-1961 | 1/1977 | Japan . |
| 58-26405 | 2/1983 | Japan . |
| 58-30484 | 7/1983 | Japan . |
| 62-13541 | 4/1984 | Japan . |
| 59-67104 | 5/1984 | Japan . |
| 59-67105 | 5/1984 | Japan . |
| 62-13542 | 4/1987 | Japan . |
| 11-56455 | 3/1999 | Japan . |

*Primary Examiner*—Jeffrey A. Smith
*Assistant Examiner*—Pedro Philogene
*Attorney, Agent, or Firm*—Morrison & Foerster, LLP.

[57] ABSTRACT

A portable cosmetic container basically comprised of a container, cover, and hinge pin, all fabricated from synthetic resin to allow the container to be recycled as a completely plastic item while providing a stable free-stop function. The hinge structure includes a hinge pin inserted within a continuous bore formed in a hinge block integrally formed on the cover part, and a hinge body integrally formed on the container part. Applying friction to said hinge pin maintains the cover at any angular open position through friction between the hinge pin and hinge block hole by a slight interference fit between the hinge pin and hole. Splines are gouged in the hinge block hole to prevent rotation of said hinge pin. The spline fixedly secures the hinge pin within the hinge body through interference fit joint.

12 Claims, 11 Drawing Sheets

COSMETIC CONTAINER

BACKGROUND OF THE INVENTION

1. Field of the Invention

The invention relates to a synthetic resin-made cosmetic container of the type in which a cover part is joined to a container part by means of a hinge mechanism.

2. Description of the Related Art

A portable cosmetic container, commonly called a "compact," is generally employed by people as means of conveniently carrying cosmetic substances. An existing type of a widely used compact is generally comprised of a structure in which the rear extremity of the cover part is rotatably joined to the rear extremity of the container part by means of a hinge, thus allowing the cover part to movably rotate as means of exposing or sealing the cosmetic substance held in the container part. This type of cosmetic container further employs a clasp mechanism installed at the front extremities of the aforesaid cover and container parts, said clasp mechanism serving as means of securing the cover to the container.

In many cases both the container and cover part of the compact are fabricated from synthetic resin for various reasons which include the desire to simplify the manufacturing process, reduce the weight of the compact, and provide convenient means of altering the appearance of the compact to attain various decorative effects.

In cases where the aforesaid container and cover parts are fabricated from synthetic resin, the hinge is normally fabricated from a metallic material. As recycling is becoming an increasingly desirable and prevalent method of conserving natural resources through reprocessing discarded items, the presence of metallic hinge pins in an otherwise all synthetic resin cosmetic container makes it difficult, time consuming, and inconvenient to recycle the compact as a synthetic resin product. Specifically, the metal hinge pins, which are often pressed into the container and cover parts through interference fit, must be removed before the compact can be recycled. Considering the difficulty of recycling a compact made from both synthetic resin and metal components, it would be advantageous to fabricate all of the compact's components, including the hinge pins, from a synthetic resin as means of making the compact completely recyclable.

SUMMARY OF THE INVENTION

This invention proposes a cosmetic container which is fabricated by all of the compact's components, including the hinge pins, made from a synthetic resin as means of making the cosmetic container completely recyclable, and especially which establishes a hinge mechanism, even if the hinge pin is made from a synthetic resin, to realize a stable free-stop function, i.e., which could stably maintain the cover part at any angle of the open position.

The cosmetic container put forth by one aspect of the invention is comprised of a synthetic resin cover part movably installed to a synthetic resin container part, a mutually connecting hinge block and hinge body integrally formed to the container part and the cover part respectively, a continuous bore comprised of separate holes formed within the hinge block and the hinge body respectively, a synthetic resin hinge pin inserted within the hinge block and the hinge body, by means of the continuous bore, in a manner as to allow rotation between the container part and the cover part, means for preventing the rotation of the hinge pin established by associating one hole of either one of the hinge block or the hinge body, with the hinge pin, and means for applying friction to the hinge pin established by associating the other hole of either the other of the hinge block or the hinge body, with the hinge pin.

Because the invention provides for a cosmetic case in which the hinge pin is made from synthetic resin alike the container and cover parts, the cosmetic case can be disposed of in a environmentally sound manner, by means of a plastic recycling process, without the troublesome necessity of removing the hinge pins.

The aforesaid hinge pin friction application means is able to provide sufficient friction between the hinge pin and hinge block hole, or between the hinge pin and hinge body hole, as means of establishing a free cover stop mechanism which is able to securely maintain the position of the cover at any opened angle.

Moreover, as the aforesaid hinge pin rotation prevention means is provided within the hole of the hinge block or hinge body, said means serves as a method of anchoring the hinge pin and allowing the rotation of the hinge pin only within the aforesaid friction application means. Therefore, the rotation prevention means always serve to provide a predetermined constant frictional resistance and to provide a necessary base for the aforesaid free cover stop mechanism.

It is advantageous to establish the length of the hinge pin within the friction application means as longer than the length thereof established within the rotation prevention means.

It becomes possible, even in cases of limited space, to apply a sufficient amount of rotational friction effectively to establish the aforesaid cover free stop mechanism.

The friction application means is comprised of a mechanism in which the diameter of the hinge pin is formed to a dimension able to allow the hinge pin to rotate in the other hole as a frictional hole, under frictional resistance.

The generation of a certain amount of friction between the pin circumference and hole wall allows the pin to rotate within the hole only after that friction is overcome. Frictional contact between the hinge pin circumference and hole wall generates an elastic adhesion effect which occurs between like resin surfaces in contact, an effect which can be applied as a mechanism to maintain the mutual positions of the pin and hole, but which can be easily overcome through a small amount of externally applied pressure.

The rotation prevention means is comprised of a spline gouged in one hole as an anchor hole to pressingly contact with the insertion front part of said hinge pin. The anchor hole may be formed either in the hinge body on said cover part, or in the hinge block on said container part. Rotation of the insertion front part of the hinge pin is thus effectively prevented by hinge pin rotation prevention means which establishes a strongly pressurized joint between the front part of the hinge pin and hole splines.

The rotation prevention means may also be comprised of one hole as an anchor hole receiving the insertion rear part of the hinge pin, the anchor hole being formed to a diameter slightly larger than the diameter of the hinge pin, and a spline gouged in the anchor hole which pressingly contacts with the insertion rear part of the hinge pin, the insertion rear part of the hinge pin being forcibly expanded as means of forming a securely fixed joint. The anchor hole is formed either in the hinge body on the cover part, or in the hinge block on the container part. Rotation of the insertion rear part of the hinge pin is thus effectively prevented by hinge pin rotation prevention means which establishes a securely fixed joint between the rear part of the hinge pin and hole wall.

The rotation prevention means may also be comprised of a knurl formed on the circumferential surface of the hinge pin, and a knurled joint formed in one hole as an anchor hole so as to be engaged with the knurl. The anchor hole having the knurled joint is formed either in the hinge body on the cover part, or in the hinge block on the container part. Rotation of the hinge pin is thus effectively prevented by hinge pin rotation prevention means which establishes a strongly pressurized knurled joint between the hinge pin and hole knurls.

DESCRIPTION OF PREFERRED EMBODIMENTS

The following discussion will provide a detailed explanation of the invention embodied as various cosmetic container structures. FIGS. 1 through 5 refer to the first embodiment.

Figure 1:
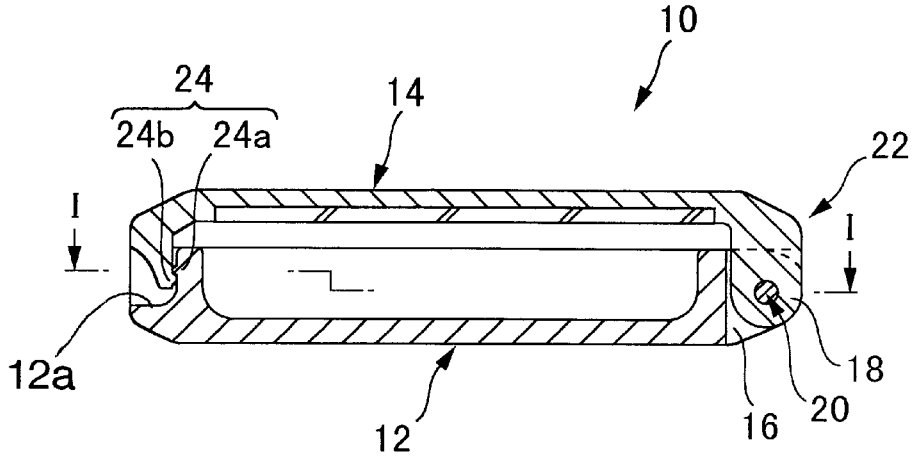
FIG. 1 is a lateral cross section of the first embodiment of the cosmetic container according to this invention.
Figure 2:
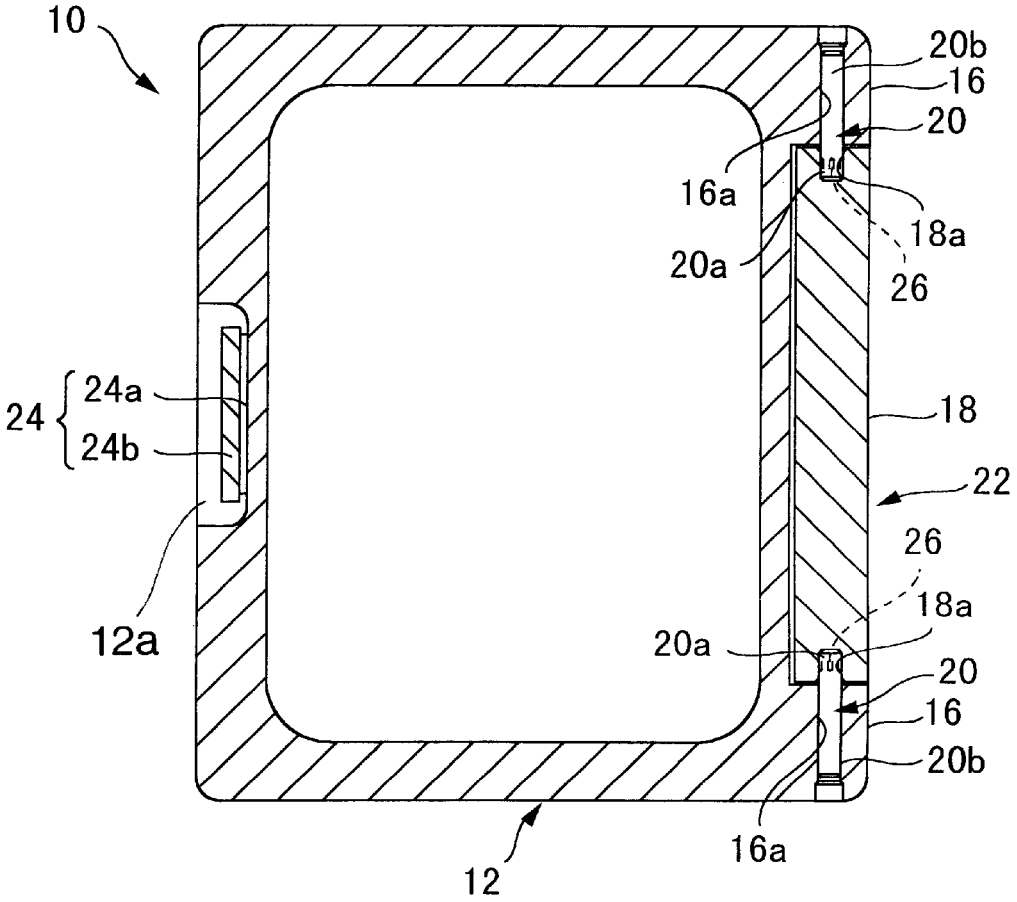
FIG. 2 is a cross section taken from line 'I—I' of FIG. 1.

As shown in FIGS. 1 and 2, the first embodiment depicts cosmetic container 10 as comprised of container 12 and cover 14, cover 14 being rotatably attached to container 12 as means of exposing or sealing the cosmetic substance contained therein. Container 12 and cover 14 are both fabricated from a synthetic resin. A pair of hinge blocks 16 is integrally formed to the rear part of container 12 (right side of the figure). Hinge body 18 is formed as an integral rear part of cover 14 and resides between hinge blocks 16. A pair of hinge pin 20 is inserted within hinge block 16 and hinge body 18 on the same axis line at both sides of container 10. Hinge blocks 16, hinge body 18, and hinge pins 20 form hinge structure 22 which provides means of rotatably attaching cover 14 to container 12 and allowing cover 14 to rotate in a manner as to expose or seal the contents contained therein. Clasp 24 is installed to the front center part of container 12 and cover 14 (left side of the figure) as means of securing cover 14 in a position that seals the contents of container 12.

Clasp 24 is comprised of stay 24*a* formed as a recessed ledge 12*a* on the front surface of container 12, and clamp 24*b* formed as a downwardly protruding lip on the front of cover 14. Clamp 24*b* hooks over the recessed ledge of stay 24*a* as means of maintaining cover 14 in a closed position, but may be easily released from stay 24*a* as a result of the intrinsic elasticity of the resin.

Figure 3:
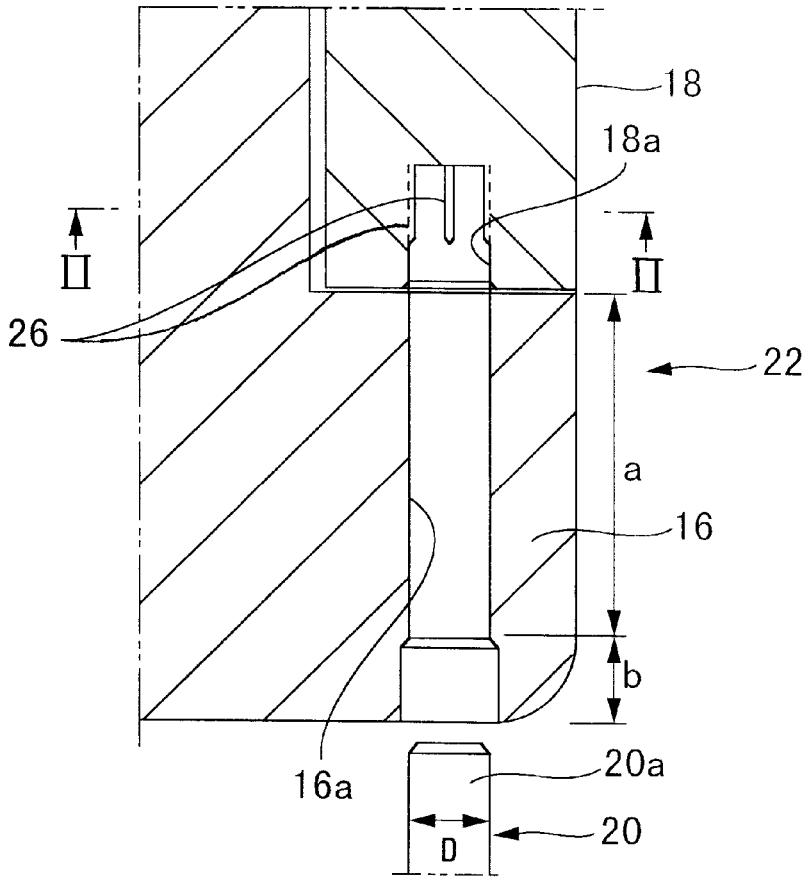
FIG. 3 is an enlarged plan view cross section of the continuous bore of FIG. 1, into which the hinge pin is inserted.
Figure 5:
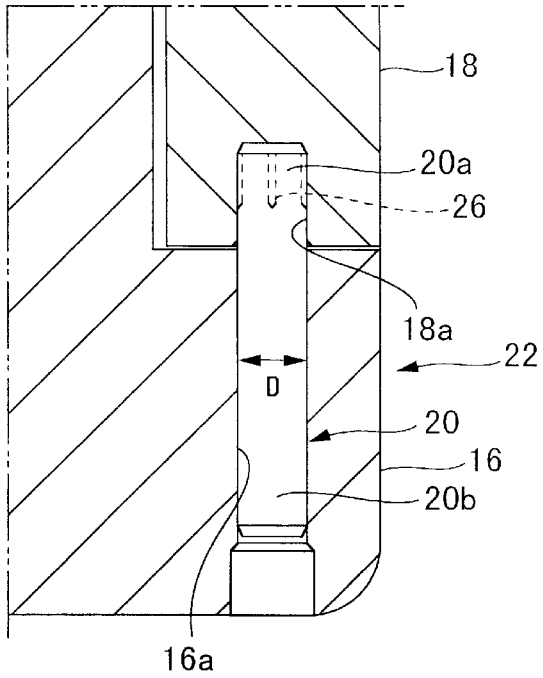
FIG. 5 is an axial cross section of the continuous bore of FIG. 1, in which the hinge pin is completely inserted.

Hinge pin 20 is fabricated from a synthetic resin, and as shown in FIGS. 3 and 5, is inserted within holes 16*a* and 18*a* mutually forming a continuous bore, as means of rotatably connecting hinge block 16 and hinge body 18. Specifically, hinge pin front part 20*a* is inserted within hole 18*a*, and hinge pin rear part 20*b* is inserted within hole 16*a*.

As shown in FIG. 3, hole 16*a* is formed within hinge block 16 to distance 'a' on the hinge body 18 side, and continues on the same axis as hole 18*a* within hinge body 18. The outwardly facing part of hole 16*a* extending along distance 'b' is formed to a slightly larger diameter as means of allowing hinge pin 20 to be easily inserted to hole 16*a*.

Hinge pin 20 is formed to a uniform diameter 'D' along its entire length, the diameter providing for a weak interference fit in which there is frictional contact between hinge pin 20 and the wall of hole 16*a*, but not enough frictional contact to prevent movement of the hinge pin within the hole 16*a*. Hinge block 16 is able to rotate on hinge pin 20, but only if pressure is applied at a strength able overcome the friction of the interference fit, thus creating a mechanism which functions as the aforesaid friction application means. For example, the diameter 'D' of the hinge pin 20 is slightly larger than that of hole 16*a* along length 'a'.

Figure 4:
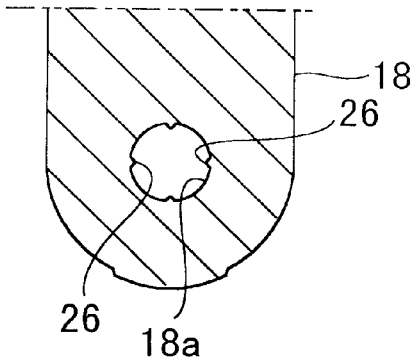
FIG. 4 is a cross section taken from line 'II—II' of FIG. 3.

As shown in FIGS. 3 and 4, splines 26 are formed on the internal wall of hole 18*a* as means of fixedly anchoring the end of hinge pin 20 therein, and thus serve as the aforesaid hinge pin rotation prevention means. This particular embodiment illustrates splines 26 as four splines oriented in the axial direction at adjacently uniform distances and protruding radially inward from the wall of hole 18*a*. Spline part 26 provides for multiple points of high pressure contact against the circumference of hinge pin 20 when the hinge pin is inserted therein, thus providing means of fixedly securing the end of hinge 20 within hole 18*a*.

Hinge block 16 is formed to a relatively thick cross section, thus making it advantageous that the length of hole 16*a* in hinge block 16, that is, the length of the distance 'a' serving as the aforesaid friction application means, be longer than the length of hole 18*a* in hinge body 18.

As mentioned previously, container 12, cover 14, and hinge pin 20 are all fabricated from a synthetic resin, thus eliminating the need to remove hinge pin 20 when the cosmetic container is discarded and recycled. As a result, the purchaser is able to conveniently and safely dispose of cosmetic container 10 by means of an environmentally sound recycling process.

Moreover, forcibly inserting hinge pin 20 into splined hole 18*a* has the effect of strongly joining the pin to the hole 18*a* in a manner as to make hinge pin 20 an integral part of hinge body 18, thus providing for a strong base against which cover 14 can open and close in relation to container 12 by frictionally rotating only against the part of hinge pin 20 not inserted within anchor hole 18*a*. As the diameter of hinge pin 20 is established to provide for a slight interference fit into hole 16*a* along length 'a', the friction of which can be easily overcome by externally applied pressure, uniform resistance is created between hinge pin 20 and hole 16*a* as means of establishing the aforesaid free stop mechanism for cover 14. Moreover, as cover 14 is allowed to rotate on hinge pin 20 only along length 'a' within hinge block 16, a uniform level of frictional resistance can be obtained as means of establishing a smoothly operating free stop mechanisms for cover 14.

Specifically, the uniform pressure applied against hinge pin 20 by hole 16*a* generates an elastic adhesion effect which occurs when two like resins are maintained in mutual frictional contact, and this effect can be used to advantage to provide for a cover which can move smoothly and easily to the touch yet maintain any opened position when no external pressure is applied.

As discussed previously, this first embodiment provides for the length of hole 16*a* along distance 'a' to be significantly longer than the length of hole 18*a*. This relationship provides for an increased friction generating surface area between hinge pin 20 and hole 16*a* which is able to apply a relatively large amount of friction. Rotating friction can thus be efficiently applied to cover 14 even when the size of the cosmetic container is relatively small. Increasing the diameter 'D' of hinge pin 20 will result in a greater amount of generated friction, but that friction remains at a level which can still provide the desired amount of resistance against the manual opening of cover 14. Moreover, abrasional wear is reduced as a result of friction being generated both on the internal wall of hole 16*a* and around the circumference of hinge pin 20, thus maintaining the desired operation of the free stop mechanism after a long period of use.

While this embodiment portrays splines 26 as the aforesaid rotational prevention means, the structure which fixedly secures hinge pin 20 in position is not limited to a splined joint.

Figure 6:
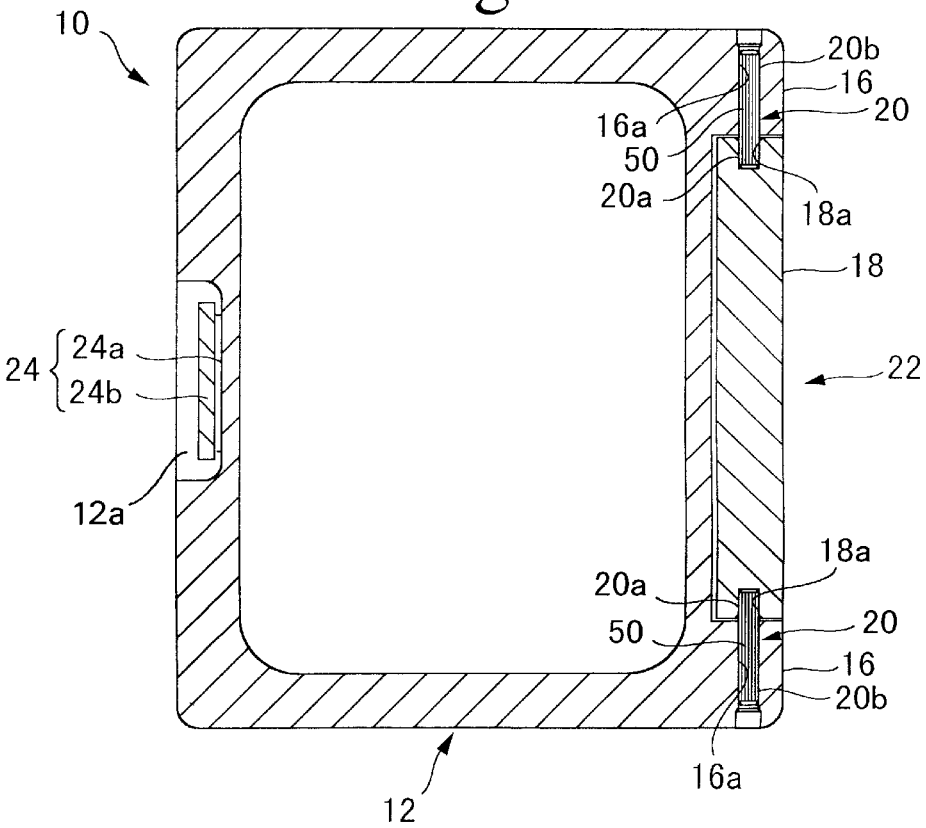
FIG. 6 is a cross sectional plan view of the second embodiment of the cosmetic container according to this invention.
Figure 7:
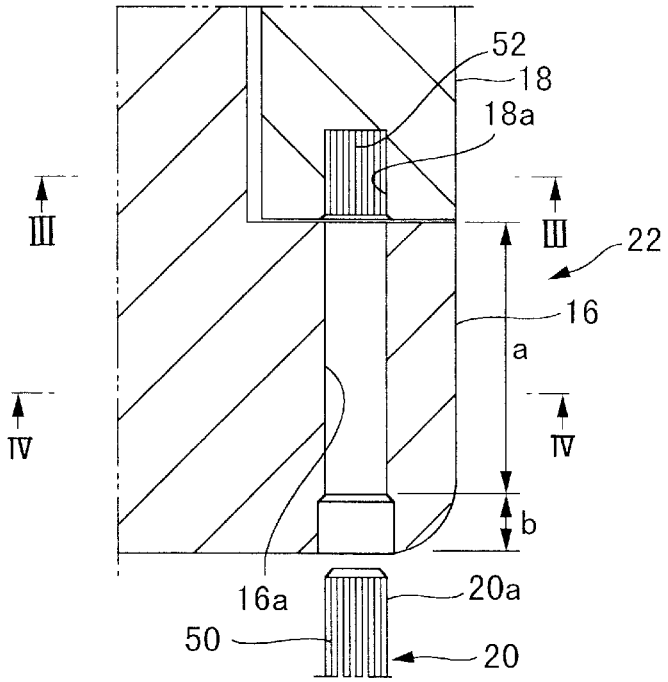
FIG. 7 is an enlarged plan view cross section of the continuous bore of FIG. 6, into which the hinge pin is inserted.
Figure 8:
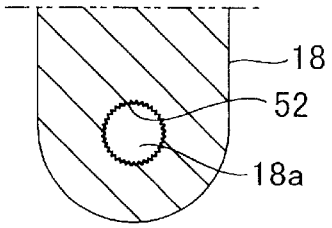
FIG. 8 is a cross section taken from line 'III—III' of FIG. 7.
Figure 9:
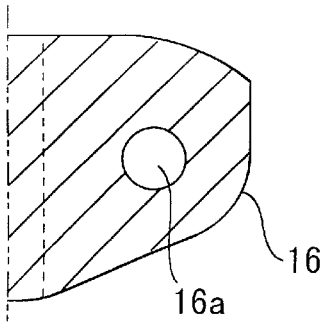
FIG. 9 is a cross section taken from line 'IV—IV' of FIG. 7.
Figure 10:
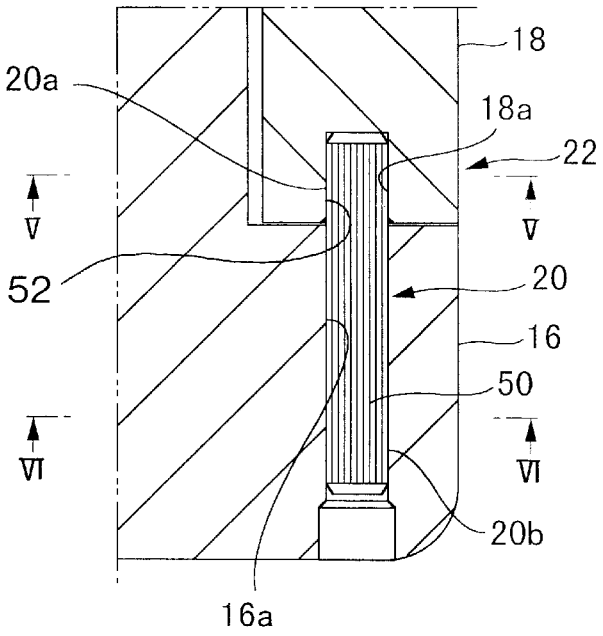
FIG. 10 is an axial cross section of the continuous bore of FIG. 6, in which the hinge pin is completely inserted.

FIGS. 6 through 12 show a second embodiment of the invention. As depicted in FIGS. 6 and 10, knurled surface 50 has been formed along the entire circumferential length of synthetic resin hinge pin 20. As further depicted in FIGS. 7 and 8, knurled surface 52 has been formed within the wall of hole 18*a* to the same diametric cross section as that formed on hinge pin 20, thus providing a strong anchor for the insertion of hinge pin 20 and thus creating a secure joint which serves as the aforesaid rotational prevention means.

Figure 11:
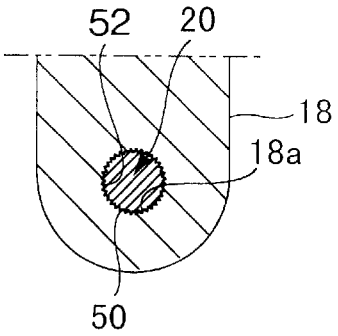
FIG. 11 is a cross section taken from line 'V—V' of FIG. 10.
Figure 12:
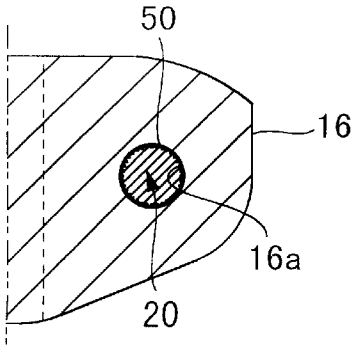
FIG. 12 is a cross section taken from line 'VI—VI' of FIG. 10.

As shown in FIG. 10, hinge pin 20 is inserted to hole 16*a* of hinge block 16 and hole 18*a* of hinge body, and as shown in FIG. 11, forward part 20*a* of knurled surface 50 fixedly mates with the internal knurled surface of hole 18*a*, thus securely preventing the rotation of part 20*a* of hinge pin 20. As is further shown in FIG. 12, rear knurled part 20*b* of hinge pin 20 resides in hole 16*a* of hinge block 16, and in the same manner as depicted in the first embodiment, is able to frictionally rotate within hole 16*a*. This second embodiment also establishes span 'a', that is, the distance of friction part of hole 16*a*, as significantly longer than hole 18*a*. Thus, this second embodiment is able to provide for the same operation and function as put forth for by the first embodiment.

Figure 13:
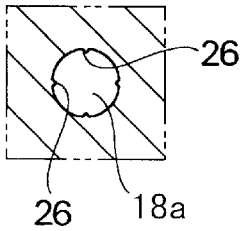
FIG. 13 is a cross section corresponding to FIG. 8, showing a modified version of the second embodiment of this invention.
Figure 14:
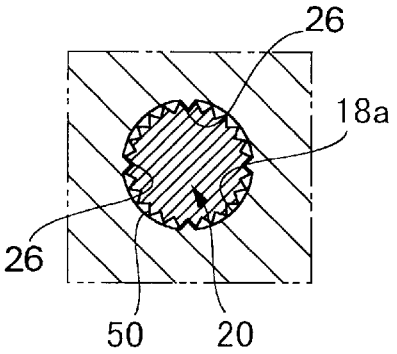
FIG. 14(*a–c*) is a cross section corresponding to FIG. 11, showing a modified version of the second embodiment of this invention.

While this second embodiment provides for knurled joint 50 and 52, said joint formed by the mutually interlocking knurled surfaces of hole 18*a* and hinge pin 20, to serve as the aforesaid rotation prevention means, the rotation prevention means is not limited to this structure alone. For example, as shown in FIG. 13, four serrations or splines 26 may be formed on the internal wall of hole 18*a* as presented in the first embodiment, and as shown in FIG. 14, these four serrations or splines may be structured so as to interlock with the knurled surface 50 of hinge pin 20. Thus, the wall of hole 18*a* may be formed to any type of serrated or splined surface capable of fixedly interlocking with the knurled surface of hinge pin 20.

Figure 15:
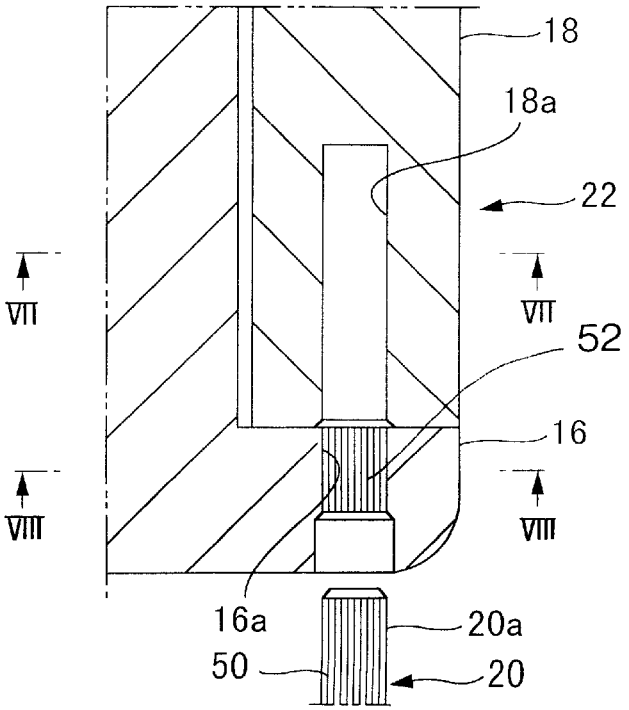
FIG. 15 is a third embodiment of an enlarged plan view cross section showing the continuous bore into which the hinge pin is inserted.
Figure 16:
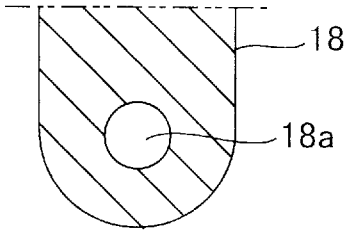
FIG. 16 is a cross sectional view taken from line 'VII—VII' of FIG. 15.
Figure 17:
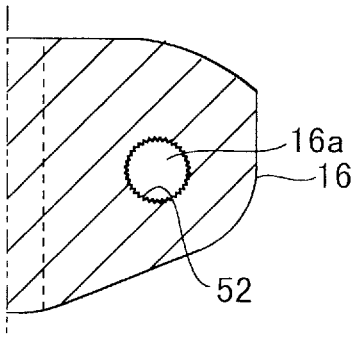
FIG. 17 is a cross sectional view taken from line 'VIII—VIII' of FIG. 15.

FIGS. 15 through 20 depict a third embodiment of the invention. Similar to the second embodiment, this third embodiment shows knurled surface 50 formed axially on the circumference of hinge pin 20. Differing from the second embodiment, however, this third embodiment provides for front part 20*a* of hinge pin 20 to rotate within hole 18*a*, and for rear part 20*b* to be fixedly anchored within hole 16*a*. As shown in FIGS. 15 and 17, knurled joint 52 is formed within hole 16*a* of hinge block 16, and thus serves as the aforesaid rotation prevention means. Hole 18*a* of hinge body 18 is formed to a round cross section.

Figure 18:
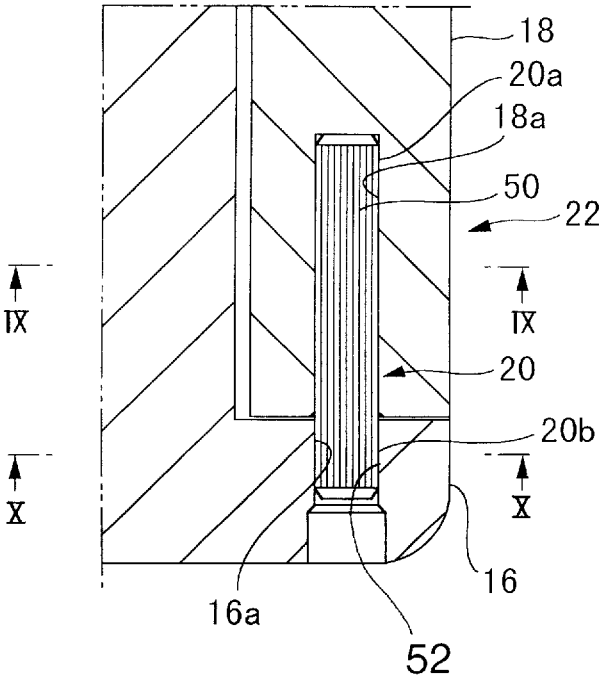
FIG. 18 is an axial cross section of the continuous bore of FIG. 15, in which the hinge pin is completely inserted.
Figure 19:
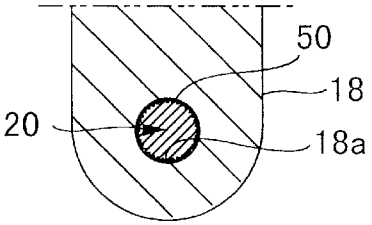
FIG. 19 is a cross sectional view taken from line 'IX—IX' of FIG. 18.
Figure 20:
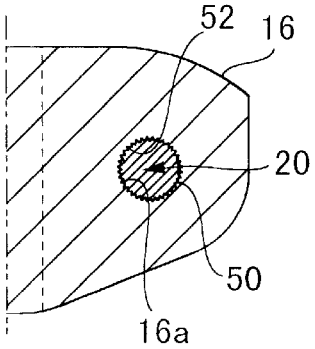
FIG. 20 is a cross sectional view taken from line 'X—X' of FIG. 18.

As shown in FIG. 18, hinge pin 20 is fully inserted to holes 16*a* and 18*a*, and as shown in FIG. 20, knurled part 50 at the rear of hinge pin 20 interlocks with the internal knurled surface of hole 16*a*, thus providing means of fixedly securing hinge pin 20 within hinge block 16. As shown in FIG. 19, the front part of knurled surface 50 is inserted within hole 18*a* through a slight interference fit, thus providing for the same frictional rotating capability as explained in the second embodiment.

In this third embodiment, as hinge block 16 is formed to a relatively small dimension along the axial length of hole 16*a*, hole 18*a* of hinge body 18 can be formed to a considerably longer length than hole 16*a*. As a result of this structure, this third embodiment is able to provide similar operations and functions as that provided by the first and second embodiments.

Figure 21:
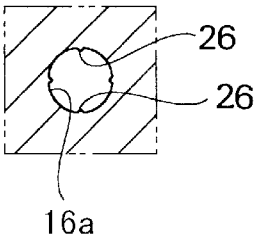
FIG. 21 is a cross section corresponding to FIG. 16, showing a modified version of the third embodiment of this invention.
Figure 22:
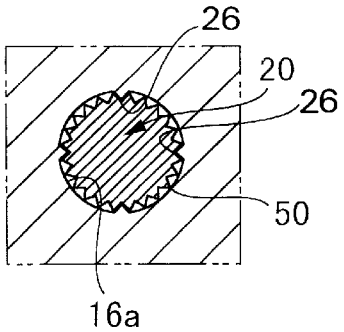
FIG. 22 is a cross section corresponding to FIG. 19, showing a modified version of the third embodiment of this invention.

While this third embodiment provides for knurled joint 50 and 52, said joint formed by the mutually interlocked knurled surfaces of hole 16*a* and hinge pin 20, to serve as the aforesaid rotation prevention means, the rotating prevention means is not limited to this structure alone. For example, as shown in FIG. 21, four serrations or splines 26, similar to those shown in the first embodiment, may be formed on the internal wall of hole 16*a*. As shown in FIG. 22, spline 26 interlocks with knurled surface 50 of hinge pin 20. It is obvious that serrations may also be formed on the axial circumference of hinge pin 20 instead of the aforesaid knurled surface.

Figure 23:
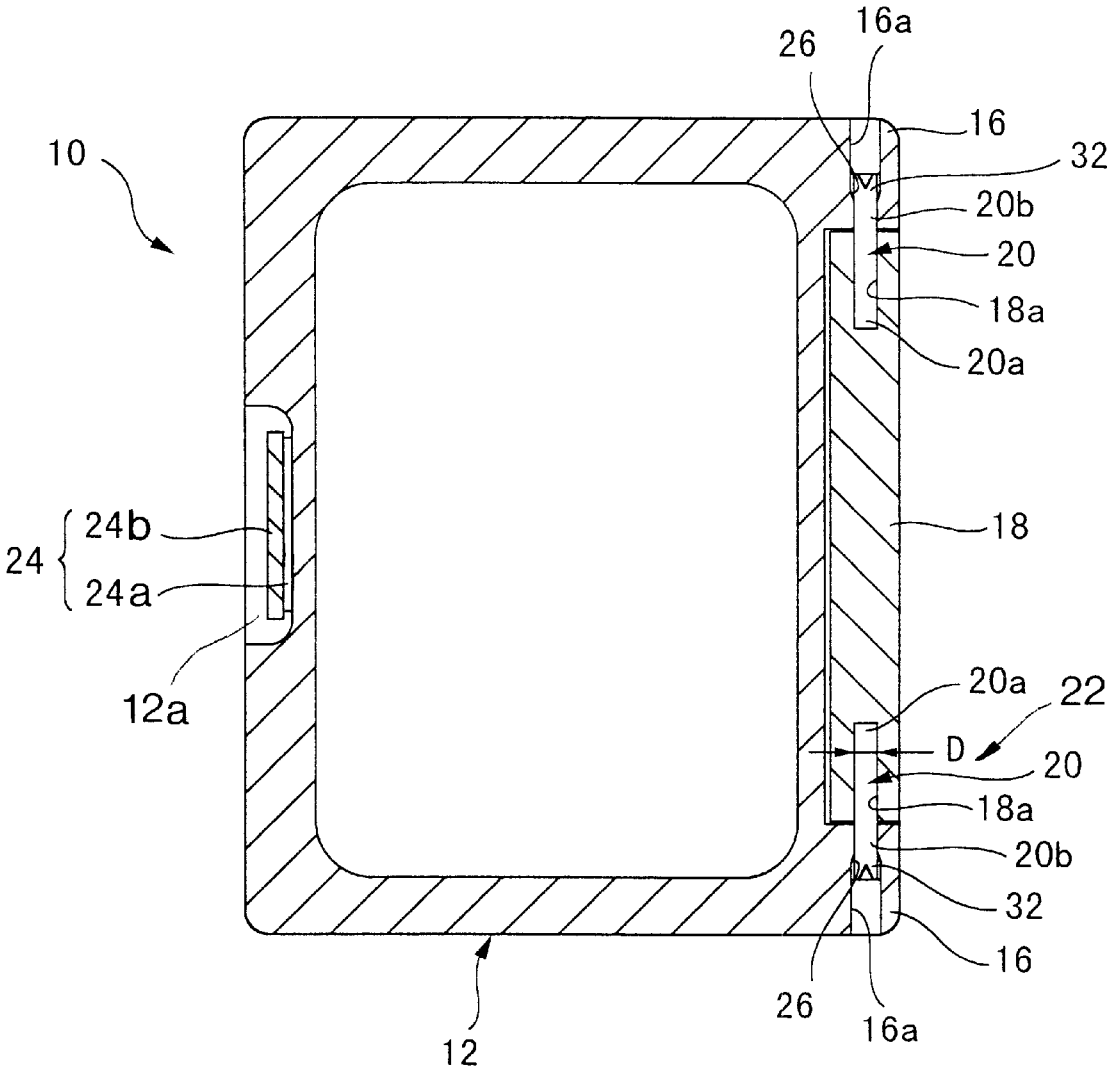
FIG. 23 is a cross sectional plan view of the fourth embodiment of the cosmetic container according to this invention.
Figure 24:
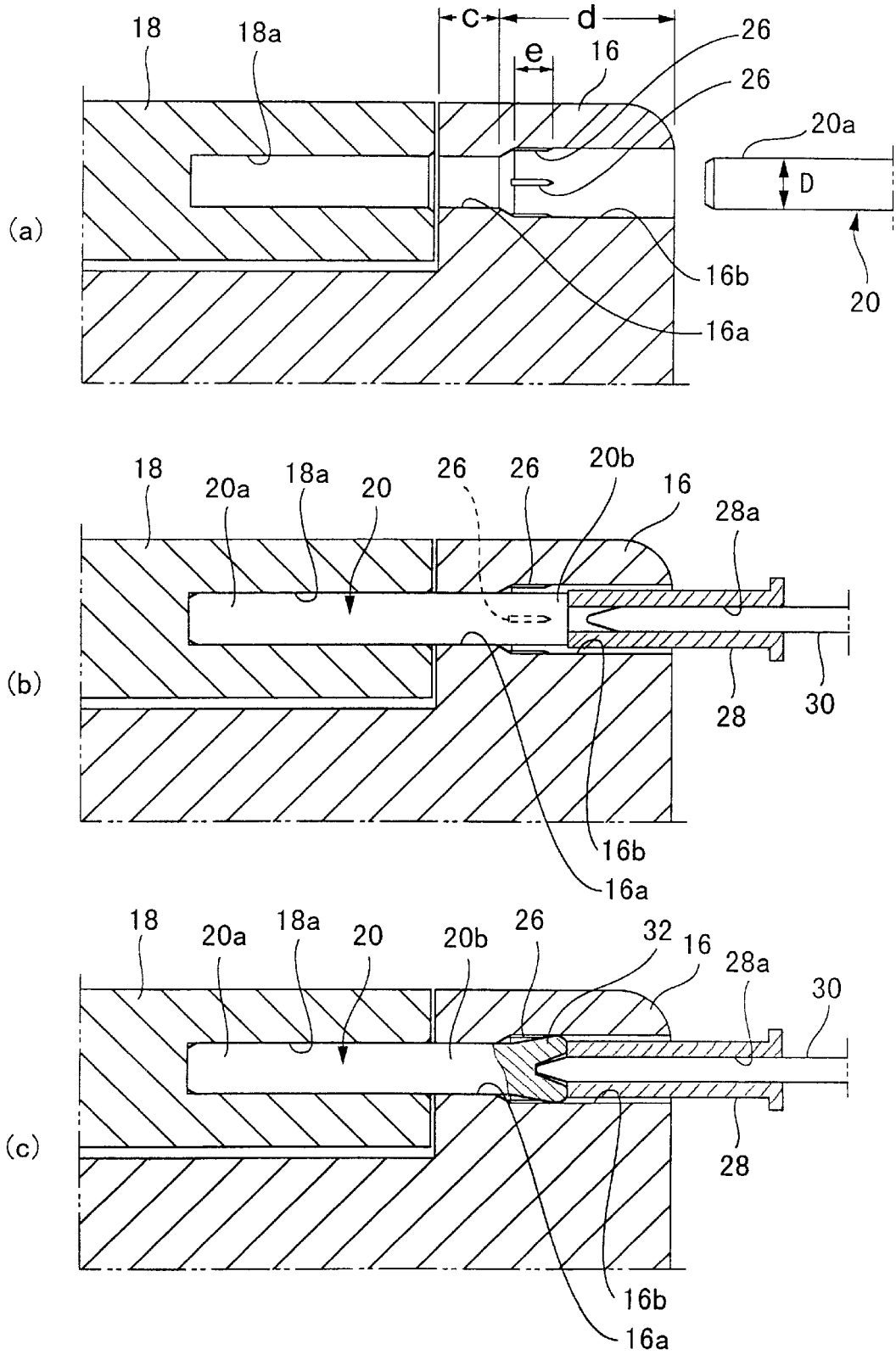
FIG. 24 shows the hinge pin insertion procedure for the fourth embodiment.

FIGS. 23 and 24 present a fourth embodiment of the cosmetic container invention whereby, similar to the third embodiment, front part 20*a* of hinge pin 20 is frictionally rotatable within hinge body 18. In a similar structure as that put forth in the first embodiment, rear part 20*b* of hinge pin 20 is securely fixed in position by interlocking with splines 26 which run only along the 'e' length of hole 16*b*.

This fourth embodiment provides a structure in which hinge pin 20 is formed to uniform diameter 'D' along its entire length, and in which the diameter of hole 18*a* and hinge pin 20 are formed to dimensions providing for a slight interference fit which, when hinge pin 20 is inserted to hole 18*a*, allows frictional rotation of hinge pin 20 within hole 18*a* only under externally applied pressure. As illustrated in FIG. 24*a*, the diameter of hole 16*a* along length 'c' is the same as the diameter of hole 18*a*, while outwardly located large hole 16*b* is formed to a slightly larger diameter along length 'd'. The aforesaid hinge pin rotation prevention means is provided for by multiple splines 26 being formed within large hole 16*b* at appropriate intervals along length 'e' in the axial direction of installed hinge pin 20. Rear part 20*b* of hinge pin 20 can be secured to splines 26 by inserting hinge pin 20 from outside cosmetic container 10.

As shown by FIG. 24*a*, front part 20*a* of hinge pin 20 passes through hole 16*a* before assuming a completely inserted position within holes 18*a* and 16*a* as shown in FIG. 24*b*. Cylindrical guide piece 28 is formed with an external diameter slightly smaller than that of hole 16*b* as means of allowing its unencumbered insertion therein. Punch 30 is inserted within guide piece 28 and placed in contact with rear part 20*b* of hinge pin 20. Impact blows are then applied to the exposed end of punch 30 as means of distorting rear part 20*b* of hinge pin 20 to form expanded part 32. Expanded part 32 is thus pressurized against splines 26 on the internal wall of hole 16*a* to form a structure which strongly secures hinge pin 20 to hinge block 16 in a fixed and non-rotatable condition.

Rear part 20*b* of hinge pin 20 is thus fixedly secured to large hole 16*b* within hinge block 16 in a manner similar to that described in the third embodiment. Front part 20*a* of hinge pin 20 is inserted within hole 18*a* through a slight interference fit which, as explained in the third embodiment, generates an amount of friction which prevents hinge body 18 from revolving on hinge pin 20 unless external pressure is applied. In this fourth embodiment the length of hinge pin 20 residing within hinge body 18 is longer than that residing within hinge block 16. This embodiment thus provides for the same operation and function as those provided by the first, second, and third embodiments.

Figure 25:
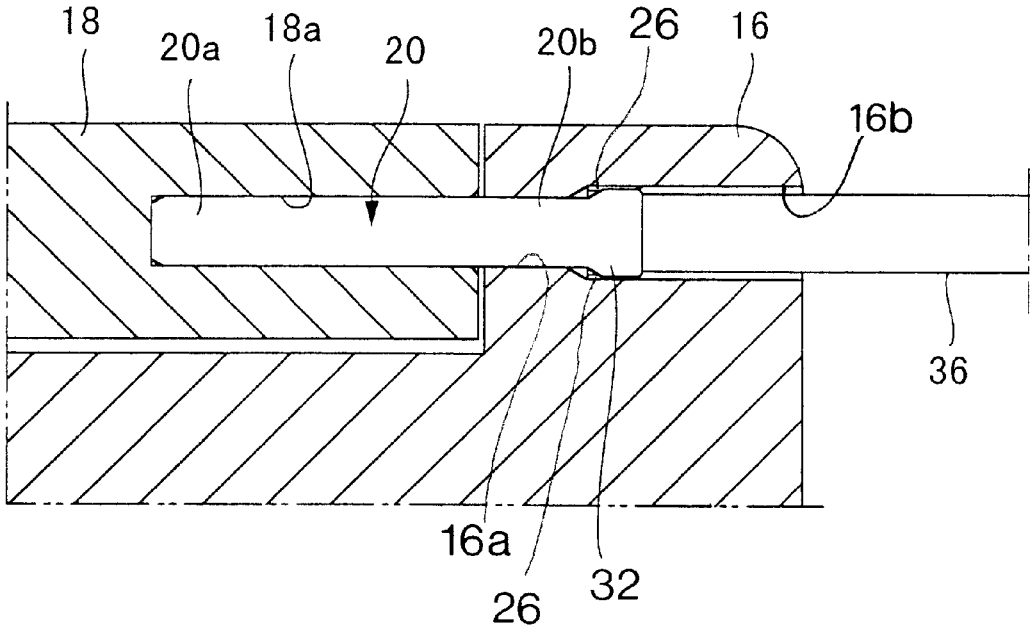
FIG. 25 is an axial cross section of the continuous bore showing a modified version of the fourth embodiment, in which the hinge pin is completely inserted.

While this fourth embodiment provides for a structure in which rear part 20*b* of hinge pin 20 is outwardly deformed as means of forming expanded part 32, the method by which rear part 20*b* is secured to the hole 16*a* is not limited to this mechanism alone. As shown in FIG. 25 for example, rear part 20*b* of hinge pin 20 can be frictionally locked to the hole wall by striking it with flat faced rod 36 or other like tool, thus causing rear part 20*b* to outwardly expand and lock within the hole 16*a*.

While the aforesaid embodiments depict hinge block 16 as an integral component formed on both sides of container 12, and hinge body 18 located there between, it is also possible to position hinge block 16 in the center and a pair of hinge bodies 18 outwardly adjacent.

Moreover, hinge pin 20 can be made of a synthetic resin of the same color as that used for container 12 and cover 14, thus allowing the color of hinge pin 20 to blend in with the surrounding color, and thus provide for a more pleasing appearance of cosmetic container 10. Moreover, in cases where it becomes desirable to form container 12 and cover 14 from a transparent synthetic resin, hinge pin 20 can also be made from the same transparent resin, and is thus able to visually blend in with container 12 and cover 14 as means of improving the appearance of the cosmetic container. Furthermore, hinge pin 20 may be made of the same synthetic resin as that used for container 12 and cover 14, and thus be visually camouflaged to blend in with the material of container 12, thus enhancing the appearance of cosmetic container 10. As explained above, hinge pin 20, as a result of being fabricated from a synthetic resin, is able to impart a more pleasing appearance to the cosmetic container and thus increase its perceived value.

While the embodiments presented here apply the invention as a relatively simple structure of the type which would be most widely utilized for a cosmetic container, the invention is by no means limited to this application. For example, the invention may also be applied to a replaceable cosmetic container installed within container 12, to the part of the cosmetic container where a cosmetic application tool is placed, to a replaceable cosmetic refill packet held within cosmetic container 10, or to other parts of a cosmetic container where a hinged joint is utilized. The invention may be applied to any type of cosmetic container, both refillable and non-refillable types, in which a synthetic resin container and cover part are connected by means of a hinged joint.

What is claimed is:

1. A cosmetic container comprised of a synthetic resin cover part movably installed to a synthetic resin container part, a mutually connecting hinge block and hinge body integrally formed to said container part and said cover part respectively, a continuous bore comprised of separate holes formed within said hinge block and said hinge body respectively, a synthetic resin hinge pin inserted within said hinge block and said hinge body, by means of said continuous bore, in a manner as to allow rotation between said container part and said cover part, means for preventing the rotation of said hinge pin established by associating one hole of either one of said hinge block or said hinge body, with said hinge pin, and means for applying friction to said hinge pin established by associating the other hole of either the other of said hinge block or said hinge body, with said hinge pin.

2. A cosmetic container as put forth in claim 1 wherein the length of said hinge pin residing in said friction application means is longer than the length thereof residing in said rotation prevention means.

3. A cosmetic container as put forth in claim 1 wherein said friction application means is comprised of a mechanism in which the diameter of said hinge pin is formed to a dimension able to allow said hinge pin to rotate in the other hole as a frictional hole, under frictional resistance.

4. A cosmetic container as put forth in claim 1 wherein said rotation prevention means is comprised of a spline gouged in one hole as an anchor hole to pressingly contact with the insertion front part of said hinge pin.

5. A cosmetic container as put forth in claim 4 wherein said anchor hole is formed within said hinge body on said cover part.

6. A cosmetic container as put forth in claim 4 wherein said anchor hole is formed within said hinge block on said container part.

7. A cosmetic container as put forth in claim 1 wherein said rotation prevention means comprises one hole as an anchor hole receiving the insertion rear part of said hinge pin, said anchor hole being formed to a diameter slightly larger than the diameter of said hinge pin, and a spline gouged in said anchor hole which pressingly contacts with said insertion rear part of said hinge pin, said insertion rear part of said hinge pin being forcibly expanded as means of forming a securely fixed joint.

8. A cosmetic container as put forth in claim 7 wherein said anchor hole is formed within said hinge body on said cover part.

9. A cosmetic container as put forth in claim 7 wherein said anchor hole is formed within said hinge block on said container part.

10. A cosmetic container as put forth in claim 1 wherein said rotation prevention means is comprised of a knurl formed on the circumferential surface of said hinge pin, and a knurled joint formed in one hole as an anchor hole so as to be engaged with said knurl.

11. A cosmetic container as put forth in claim 10 wherein said anchor hole having said knurled joint is formed within said hinge body on said cover part.

12. A cosmetic container as put forth in claim 10 wherein said anchor hole having said knurled joint is formed within said hinge block on said container part.

* * * * *